US009759209B2

(12) United States Patent
Fang et al.

(10) Patent No.: US 9,759,209 B2
(45) Date of Patent: Sep. 12, 2017

(54) ELLIPTICAL SHAPED HERMETIC COMPRESSOR SHELL WITH OFFSET ELECTRICAL CONNECTOR

(71) Applicant: HUANGSHI DONGBEI ELECTICAL APPLIANCE CO., LTD., Huangshi (CN)

(72) Inventors: Zeyun Fang, Huangshi (CN); Lijian Cao, Huangshi (CN); Xinnan Wang, Huangshi (CN); Bin Gan, Huangshi (CN); Liangfu Cheng, Huangshi (CN); Xi Chen, Huangshi (CN)

(73) Assignee: HUANGSHI DONGBEI ELECTRICAL APPLIANCE CO., LTD., Huangshi, Hubei (CN)

( * ) Notice: Subject to any disclaimer, the term of this patent is extended or adjusted under 35 U.S.C. 154(b) by 175 days.

(21) Appl. No.: 14/143,892

(22) Filed: Dec. 30, 2013

(65) Prior Publication Data

US 2014/0112811 A1 Apr. 24, 2014

Related U.S. Application Data

(63) Continuation of application No. PCT/CN2012/072585, filed on Mar. 20, 2012.

(30) Foreign Application Priority Data

Oct. 28, 2011 (CN) ..... 2011 1 0332670

(51) Int. Cl.
*F04B 39/12* (2006.01)
*F04B 53/16* (2006.01)
*F04B 39/00* (2006.01)

(52) U.S. Cl.
CPC ..... *F04B 39/127* (2013.01); *F04B 39/0061* (2013.01); *F04B 39/121* (2013.01); *F04B 39/123* (2013.01); *F04B 53/16* (2013.01)

(58) Field of Classification Search
CPC .... F04B 39/12; F04B 39/123; F04B 39/0061; F04B 39/121; F04B 39/14; F04B 39/0033;
(Continued)

(56) References Cited

U.S. PATENT DOCUMENTS 3,849,028 A * 11/1974 Kurita ..... F04B 39/127 417/363
3,887,303 A * 6/1975 Matsuzaka ..... F04B 39/127 417/363
(Continued)

FOREIGN PATENT DOCUMENTS

CN 1077522 10/1988
CN 202300942 7/2002
(Continued)

OTHER PUBLICATIONS

International Search Report PCTCN2012/072585; dated Aug. 9, 2012, 5 pages.*
(Continued)

*Primary Examiner* — Bryan Lettman
*Assistant Examiner* — Timothy Solak
(74) *Attorney, Agent, or Firm* — Hamre, Schumann, Mueller & Larson, P.C.

(57) ABSTRACT

A sealed compressor housing includes a tubular top cover and a tubular lower housing each with an elliptical horizontal cross section that can be snap-fitted together. Major and minor axial centerlines of the top cover and the lower housing respectively coincide with each other. A terminal pin is provided on the lower housing and is disposed axially symmetrical about a centerline of the terminal pin. A portion of the top face on the side of the terminal pin and a front side of the top face are higher than a rear side thereof. A bottom outer surface of the lower housing has a smooth ellipsoid
(Continued)

shape. An angle is formed between the centerline of the terminal pin and the major axial centerlines.

7 Claims, 3 Drawing Sheets

(58) Field of Classification Search
CPC .. F04B 11/0008; F04B 53/002; F04B 23/021; F04B 41/02; F04B 53/22; F04B 53/16; F04B 39/127
See application file for complete search history.

(56) References Cited

U.S. PATENT DOCUMENTS 4,106,881 A * 8/1978 Stannow ..... F04B 39/12 310/51
4,406,593 A * 9/1983 Kessler ..... F04B 39/122 248/618
4,412,791 A * 11/1983 Lal ..... F04B 39/127 292/24
4,431,383 A * 2/1984 Boehmler ..... F04B 39/127 417/312
4,729,723 A 3/1988 Outzen
5,228,843 A 7/1993 Novolan et al.
5,487,648 A * 1/1996 Alfano ..... F04B 39/121 181/202
5,538,404 A * 7/1996 DiFlora ..... F04B 39/121 181/200
2002/0051716 A1* 5/2002 Seo ..... F04B 39/0033 417/415
2004/0126249 A1* 7/2004 Ono ..... F04B 39/121 417/363
2004/0219034 A1* 11/2004 Gilliam ..... F04B 39/121 417/360
2008/0173644 A1* 7/2008 Tomell ..... F04B 49/10 220/89.1

FOREIGN PATENT DOCUMENTS

CN 1769698 5/2006
CN 102352830 2/2012
JP 2002-130132 5/2002
WO 2010/080984 7/2010

OTHER PUBLICATIONS

Supplementary European Search Report issued in corresponding European patent application, dated Feb. 2, 2015.

* cited by examiner

ELLIPTICAL SHAPED HERMETIC COMPRESSOR SHELL WITH OFFSET ELECTRICAL CONNECTOR

FIELD

This disclosure belongs to the field of compressor manufacturing, in particular, relating to a small-sized sealed refrigeration compressor housing.

BACKGROUND

Currently in the field of sealed refrigeration compressors for refrigerators, a compressor housing generally is made by snap fitting together an upper cover and a lower shell. The upper cover and the lower shell each have a cylindrical shape with an elliptical cross-section. The major axial centerlines of the elliptical cross-section of the upper cover and the lower shell are aligned with each other. A terminal pin bore of the lower shell has a centerline of symmetry in a horizontal direction (also known as a terminal pin bore centerline). The centerline of the terminal pin bore is designed to align with the major axial centerlines of the upper cover and the lower shell. Meanwhile, in order to simplify the process of welding compressor feet onto the bottom of the lower shell, planes for welding the compressor feet are symmetrically positioned on opposite sides of the major axial centerline of the upper cover and the lower shell. When this symmetrical design is utilized, the production and its related processing technology are relatively simple, and the compressor takes on a symmetrical and aesthetically pleasing appearance. However, the space utilization of the compressor housing is not optimal, and the external dimensions and weight of the housing are also consequentially increased. In order to meet the requirements toward miniaturization and energy consumption reduction for compressors, there is a need for a rational layout design to reduce the sizes of the housing, to reduce the weight of the compressor, to reduce the cost of the compressor (parts and transportation), and to enhance the market competitiveness of the compressor.

SUMMARY

The technical problem to be solved by this disclosure is to make improvements on the structure of currently available compressor housing. The embodiments described herein provide a compressor housing that is hermetic and spatially compact with relatively smaller dimensions and light weight. The compressor housing described herein is easy to produce and is particularly suitable for use as a small-sized, sealed refrigeration compressor housing.

In one embodiment, a sealed compressor housing includes an upper cover and a lower shell each have a cylindrical shape with an elliptical horizontal cross-section. The upper cover and the lower shell can be snap-fitted together with a major elliptical axial centerline and a minor elliptical axial centerline of the upper cover being aligned with a respective major elliptical axial centerline and a respective minor elliptical axial centerline of the lower shell. The elliptical major axial centerlines are aligned with a centerline of a cylinder bore of a compressor cylinder block. A terminal pin is located on the lower shell and is symmetrically formed with respect to a centerline of a terminal pin bore. A top surface of the upper cover is an asymmetric spherical contraction. The top surface on the side of the terminal pin and a front side of the top surface are higher than a rear side of the top surface. A bottom surface of the lower shell is a smooth ellipsoidal contraction. The centerline of the terminal pin bore forms an angle with the elliptical major axial centerlines of the upper cover and the lower shell.

According to the above embodiment, an angle A between the centerline of the terminal pin bore and the elliptical major axial centerlines is formed by a clockwise rotation of the centerline of the terminal pin bore with respect to the elliptical major axial centerline. The angle A is in the range of 10° to 45°.

According to the above embodiment, an internal side of a bottom portion of the lower shell is provided with four welding planes for internal support pins that support pump components inside the housing. Two of the planes are symmetrically positioned on opposite sides of the elliptical major axial centerline. The remaining two of the planes are spaced apart and positioned on the elliptical major axial centerline. The welding planes are positioned with an offset toward the side of a rear portion of the compressor cylinder block.

According to the above embodiment, the lower shell has a bottom portion having a smooth ellipsoidal outer surface. On the side of the terminal pin and the opposite side of the bottom portion, welding surfaces are respectively provided for welding compressor feet onto the bottom portion of the lower shell. The welding surfaces are curved and have a curvature consistent with that of the outer surface. Two of the welding surfaces on either side are distributed on opposite sides of the centerline of the terminal pin bore. The welding surfaces are distributed along a periphery of the bottom portion of the lower shell, and are configured to weld a corresponding welding end of a compressor foot. The welding end of each compressor foot are two forked and interconnected, upwardly arching, curved welding surfaces that are consistent with the curvature of the welding surface. An opposite end of each compressor foot is a supporting plane having a distance of 3 to 8 mm from the lowest point on the lower shell bottom. A centerline connecting the compressor foot supporting planes on the two opposite sides is in alignment with the terminal pin bore centerline.

According to the above embodiment, the lower shell sidewall is provided with two lower shell retaining grooves that are symmetrically positioned with respect to the elliptical major axial centerline. The upper cover is provided with three upper cover retaining grooves where two of the grooves are symmetrically positioned on opposite sides of the elliptical major axial centerline and at a location above the head portion of the compressor cylinder block, and the third groove is positioned on the elliptical major axial centerline and at a location above the rear portion of the compressor cylinder block. The grooves are sunk below the outer surface of the housing into the inside of the housing and form smooth projections on the interior wall of the housing.

The shape of the grooves is one of circular, oval, or smooth polygonal.

According to the above embodiment, at a location above the terminal pin bore, the upper cover and the lower shell are each provided with a positioning plane that have equal width and match each other. Each of the positioning planes makes a smooth transition to the housing body.

According to the above embodiment, the upper cover is provided with an enhancing groove at a location above the positioning plane thereof. The enhancing groove is sunk below the outer surface of the upper cover into the inside of the upper cover and forms a smooth projection on the interior wall of the housing. The enhancing groove is a vertically straight strip.

According to the above embodiment, the housing is suitable for use as a small-sized sealed refrigeration compressor housing.

The embodiments described therein have the following advantages compared to existing technologies:

1. A terminal pin bore centerline of a lower shell is aligned to not coincide with major axial centerlines of elliptical cross-sections of the lower shell or an upper cover, nor coincide with a cylinder bore centerline for a compressor cylinder block. Instead, the terminal pin bore centerline of the lower shell is rotated an angle A (10° to 45°) with respect to the major axial centerlines. This allows a terminal pin of the housing to keep away from other components inside the housing such as, for example, a muffler chamber, a compressor cylinder cover, etc. This can prevent collision among the compressor cylinder cover, the muffler chamber, and the terminal pin. The need to extend the length of the elliptical major axial centerline of the housing is eliminated, the dimensions of the housing are minimized, the amount of space needed is reduced, and the cost is lowered.

2. Four welding planes are provided on a bottom of the lower shell for welding four respective internal support pins, which are compactly positioned. In order to allocate maximum space to accommodate components inside the housing such as, for example, the compressor cylinder cover, the muffler chamber, etc., the location of the welding planes as a whole is offset toward the rear portion of the compressor cylinder block. The four planes are used to support pump components inside the compressor housing.

3. The lowest part of the lower shell bottom is no longer an entirely flat surface upon which the compressor feet are welded. Instead, the compressor foot welding surface is a curved welding surface formed on a bottom surface of the lower shell. The bottom surface is a smooth ellipsoidal outer surface of the lower shell bottom that has a curvature consistent with that of the lower shell. This allows the supporting planes of the compressor feet to be at 3 mm to 8 mm above the lowest part of the lower shell bottom, therefore allowing the outer surface of the lower shell bottom to be of a smooth ellipsoidal shape instead of a cylindrical shape. Thus the amount of oil injected can be minimized and the overall height of the compressor is reduced.

4. In order to prevent collision among critical compressor components during transportation, the lower shell is designed with two retaining features that are symmetrically positioned on opposite sides of the elliptical major axial centerline, and these features prevent a lower portion of a pump from moving left and right beyond an acceptable movement range.

The upper cover has three retaining features. Two of the retaining features are positioned on opposite sides of the elliptical major axial centerline of the housing so as to limit the left and right movement range of the compressor cylinder cover. The third retaining feature is positioned above the rear portion of the compressor cylinder block, so as to limit the front and back movement range of the rear portion of the compressor cylinder block.

5. In order to prevent the upper cover and the lower shell from rotating into dislocation during the assembly process, two matching positioning planes are incorporated into the design of the mating surfaces of the upper cover and the lower shell to facilitate the mating and positioning of the upper cover and the lower shell.

6. An enhancing groove is positioned above the upper cover positioning plane to enhance the integrity of the upper cover.

Figure 1:
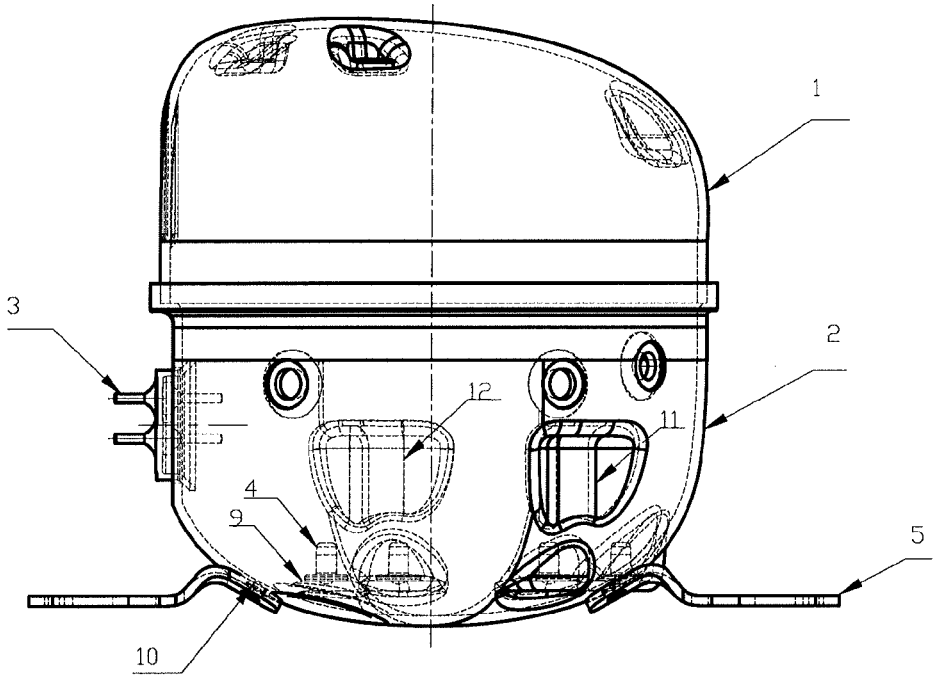
FIG. 1 is a front perspective view of a compressor housing, according to one embodiment.

Features in the drawings include the following: 1—upper cover, 2—lower shell, 3—terminal pin, 4—internal support pin (4), 5—compressor foot (2), 6—compressor cylinder block, 7—compressor cylinder cover, 8—intake muffler chamber, 9—welding plane for internal support pin (4 locations), 10—curved compressor foot welding surface (4 locations), 11—first retaining groove on the lower shell, 12—second retaining groove on the lower shell, 13—first retaining groove on the upper cover, 14—second retaining groove on the upper cover, 15—third retaining groove on the upper cover, 16—lower shell positioning plane, 17—upper cover positioning plane, 18—upper cover groove, 19—rear portion of compressor cylinder block, 20—head portion of compressor cylinder block, 21—elliptical major axial centerline (compressor cylinder block cylinder bore centerline), 22—elliptical minor axial centerline, 23—terminal pin bore centerline.

DETAILED DESCRIPTION

Figure 2:
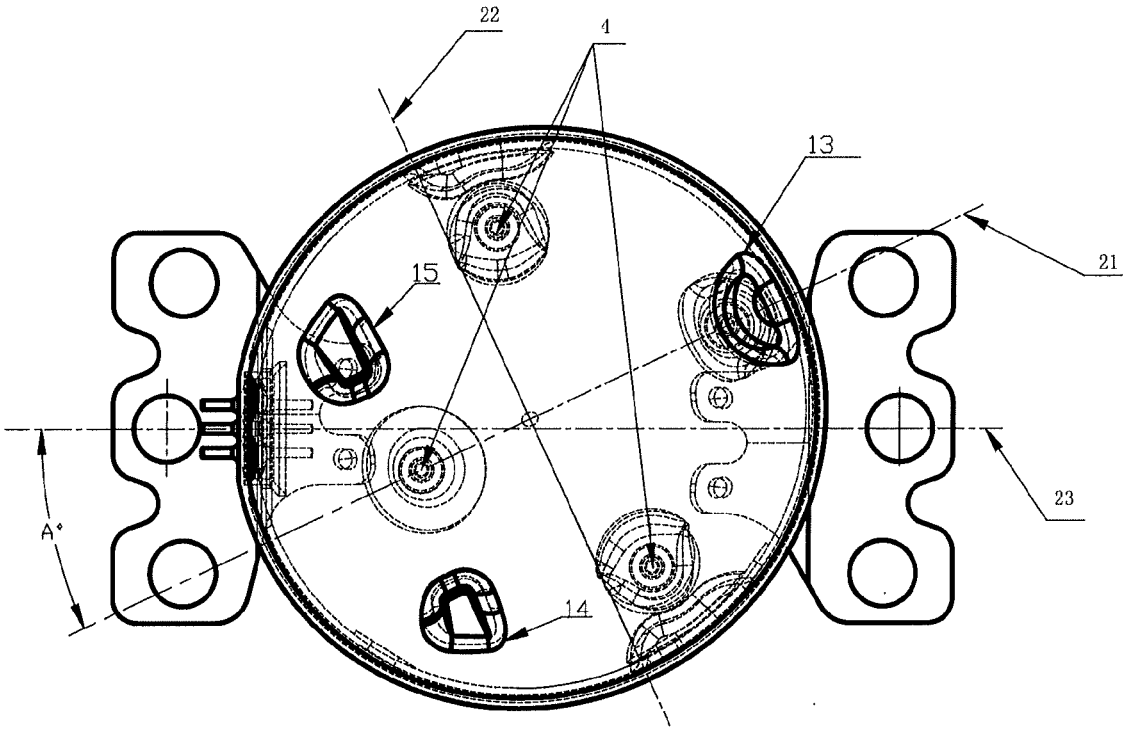
FIG. 2 is a top perspective view of the compressor housing of FIG. 1.
Figure 3:
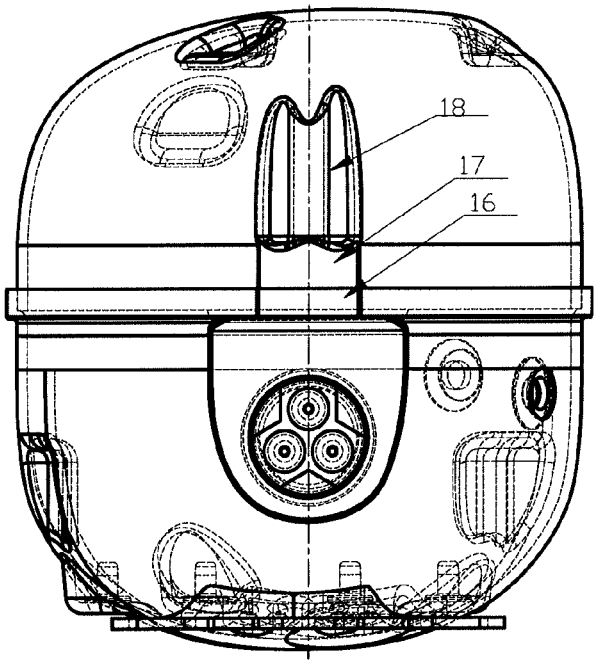
FIG. 3 is a left side perspective view of the compressor housing of FIG. 1.
Figure 4:
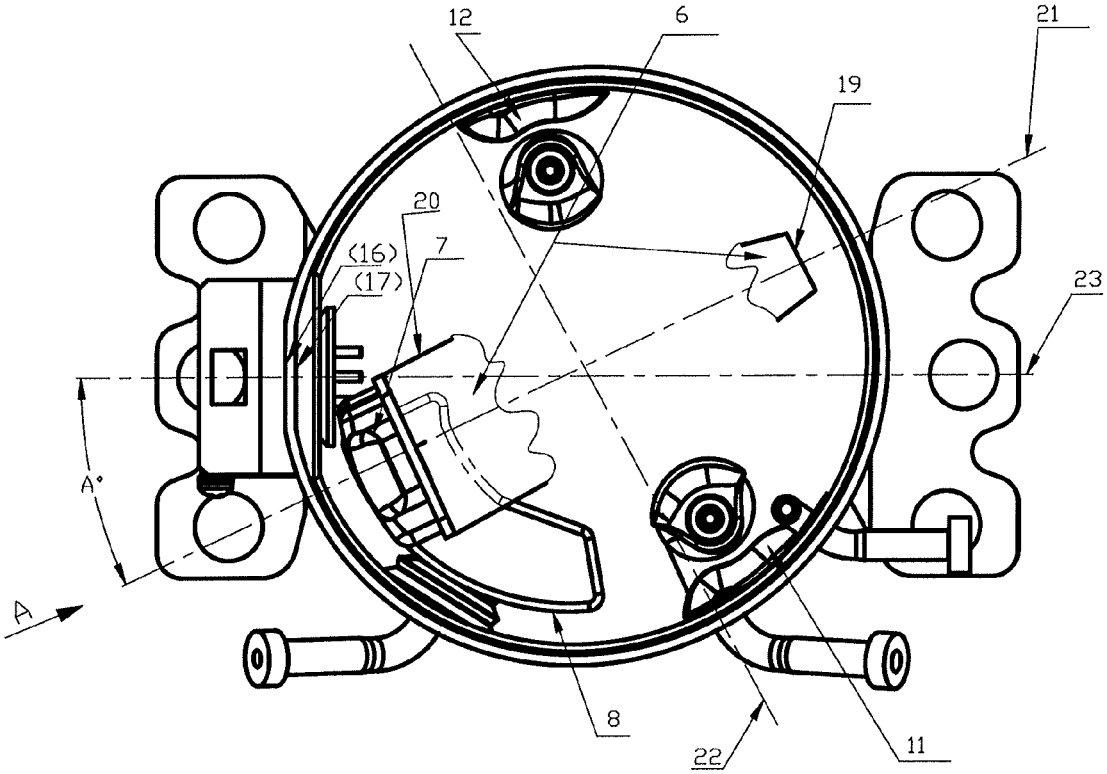
FIG. 4 is a top view of a general assembly of the compressor housing of FIG. 1.
Figure 5:
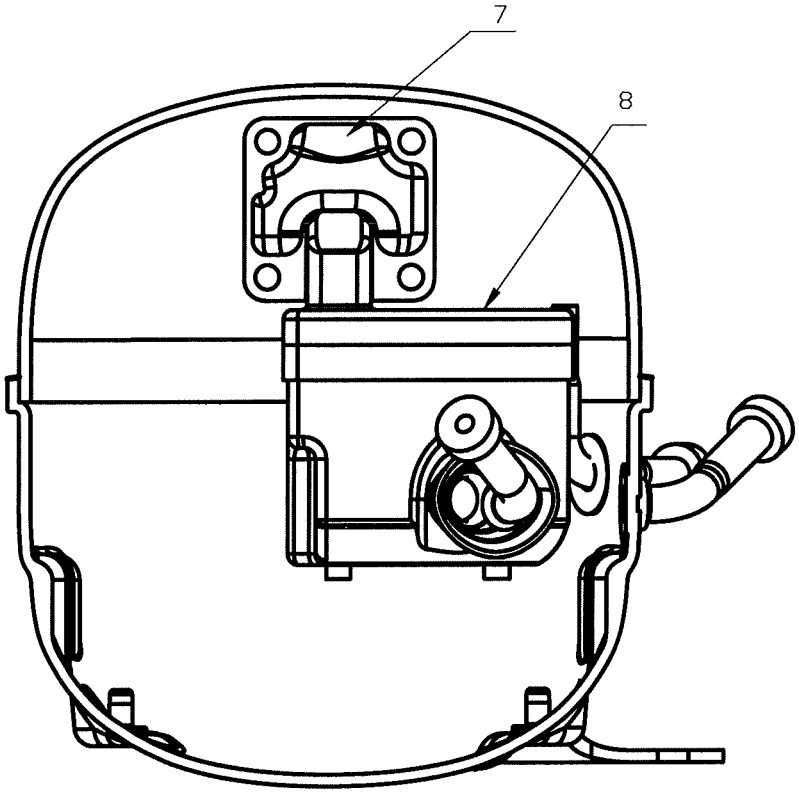
FIG. 5 is a side view of FIG. 4 along an axis A.

The following, in conjunction with the examples in FIGS. 1-5, provides a detailed description of the embodiments which are to be considered in all respects as illustrative and not limiting.

In reference to FIGS. 1-5, a compressor housing suitable for a sealed refrigeration compressor, for example, a small-sized, sealed refrigeration compressor, is provided. The compressor housing includes an upper cover 1 and a lower shell 2. The upper cover 1 and the lower shell 2 each have a cylindrical shape and can be snap-fitted together. The upper cover 1 and the lower shell 2 each have an elliptical horizontal cross-section. An elliptical major axial centerline of the elliptical horizontal cross-section of the upper cover 1 and that of the lower shell are aligned with each other as a major axial centerline 21. Similarly, an elliptical minor axial centerline of the elliptical horizontal cross-section of the upper cover 1 and that of the lower shell are aligned with each other as a minor axial centerline 22.

A terminal pin 3 is provided on the lower shell 2 and is symmetrically disposed with respect to a terminal pin bore centerline 23. The upper cover 1 has a top surface that is an asymmetric spherical contraction. A portion of the top surface on the side of the terminal pin 3 and a front side portion of the top surface are higher than a rear side portion of the top surface. The lower shell 2 has a bottom surface that is a smooth ellipsoidal contraction.

A compressor cylinder block 6 is positioned along the major axial centerline 21 and attached to the compressor housing via respective cylinder bores at ends thereof. The cylinder bores are disposed around a cylinder bore centerline that is aligned to coincide with the major axial centerline 21. The compressor cylinder block 6 includes a larger end that is a head portion 20, and a smaller end that is a rear portion 19 of the compressor cylinder block 6. A compressor cylinder cover 7 and a muffler chamber 8 are located at the head portion 20 of the compressor cylinder block 6.

The terminal pin bore centerline 23 forms an angle A (10° to 45°) with the major axial centerline 21. This can prevent collision between the compressor cylinder cover 7 and the terminal pins and between the muffler chamber 8 and the terminal pin 3. This structure can eliminate the need to extend the length of the elliptical major axial centerline of the lower shell, thereby reduce the amount of space and cost.

Four welding planes 9 are provided at an internal side of a bottom portion of the lower shell 2. The welding planes 9 are configured to weld internal support pins 4 to the lower shell 2. Two of the welding planes 9 are symmetrically located on opposite sides of the major axial centerline 21. The other two of the welding planes 9 are spaced apart and located along the major axial centerline 21. The welding planes 9 as a whole are positioned with an offset toward the side of the rear portion 19 of the compressor cylinder block 6 to provide a compact configuration. The offset toward the side of the rear portion 19 can allocate a maximum space to accommodate components of the compressor such as, for example, the compressor cylinder cover 7, the muffler chamber 8, etc. The welding planes 9 can support, for example, pump components inside the compressor housing.

Welding surfaces 10 are formed on a bottom portion of the lower shell 2 for welding respective compressor feet 5 to the lower shell 2. The welding surfaces 10 are respectively disposed on the side of the terminal pin 3 and the opposite side. The welding surfaces 10 are curved and have a curvature that is consistent with that of an outer surface of the bottom portion of the lower shell 2. The welding surfaces 10 are positioned on opposite sides of the terminal pin bore centerline 23, with two of the welding surfaces 10 positioned on one side and two of the welding surfaces 10 posited on the opposite side. The welding surfaces 10 are distributed along a periphery of the bottom portion of the lower shell 2 that has a smooth ellipsoidal shape. The welding surfaces 10 can correspondingly weld welding ends of the compressor feet 5 thereon.

The welding ends of the compressor feet 5 each include a curved welding surface with two forked interconnections. The curved welding surfaces each upwardly arch and have a curvature consistent with that of the respective welding surfaces 10 of the lower shell 2. A supporting plane is provided at the opposite end of the respective compressor feet 5, which is about 3 to 8 mm (preferably 5 mm) away from the lowest point on the bottom portion of the lower shell 2. A centerline connecting the supporting planes of the compressor feet 5 on opposite sides of the bottom shell 2 is aligned to coincide with the terminal pin bore centerline 23. In this embodiment, the compressor feet 5 are directly welded onto the welding surfaces 10 that have a curvature consistent with that of the lower shell 2, instead of welding a compressor foot onto an entirely flat surface on the lowest part of a lower shell. This allows the outer surface of the bottom portion of the lower shell 2 to have a smooth ellipsoidal shape instead of a cylindrical shape. Thus the amount of oil injected into the compressor housing can be minimized and the overall height of the compressor can be reduced.

A first retaining groove 11 and a second retaining groove 12 are provided on a side wall of the lower shell 2. The first and second retaining grooves 11 and 12 of the lower shell 2 are symmetrically positioned with respect to the major axial centerline 21, and are configured to prevent excessive left and right movements of a lower portion of a pump.

Three retaining grooves are provided on the upper cover 1, including first, second and third retaining grooves 13, 14 and 15. The second retaining groove 14 and the third retaining groove 15 of the upper cover 1 are symmetrically positioned on opposite sides of the major axial centerline 21 and are positioned above the head portion 20 of the compressor cylinder block 6, so as to limit the left and right movements of the compressor cylinder cover 7. The first retaining groove 13 of the upper cover 1 is positioned on the major axial centerline 21 and at a location above the rear portion 19 of the compressor cylinder block 6, so as to limit the range of front and back movement of the rear portion 19 of the compressor cylinder block 6.

The grooves 11-15 are sunk below the outer surface of the compressor housing into an inside of the housing and form smooth projections on an interior wall of the housing. The grooves 11-15 may be circular, oval, or smooth polygonal.

The housing is used as a sealed housing for a compressor. The major and minor elliptical axial centerlines of the upper cover 1 are respectively aligned to coincide with the respective major and minor elliptical axial centerlines of the lower shell 2. To prevent the upper cover 1 and the lower shell 2 from misplacement when rotated with respect to each other during assembly, positioning planes 16 and 17 are provided as mating surfaces configured to engage the upper cover 1 and the lower shell 2 and to facilitate the mating and positioning of the upper cover 1 and the lower shell 2. The positioning plane 17 with a particular width is provided above a terminal pin bore on the upper cover 1. The positioning plane 16 is provided on the lower shell 2 and has a width matching the width of the positioning plane 17. The positioning planes 16 and 17 each have a smooth transition into their respective cover/shell.

An enhancing groove 18 is provided above the positioning plane 17 of the upper cover 1 to improve the strength of the upper cover 1. The enhancing groove 18 is sunk below the outer surface of the upper cover 1 into the inside of the upper cover 1, and forms a smooth projection on the interior wall of the upper cover 1. The enhancing groove 18 includes a vertically straight strip.

The above disclosure is only intended to illustrate the preferred embodiments of the present invention and is not intended to limit the scope of the present invention. Therefore any equivalent changes made based on the disclosure of the present invention, such as improvements on the process parameters or the apparatus, are still within the protective scope of the present invention.

The invention claimed is:

1. A compressor housing, comprising:

an upper cover;

a lower shell;

the upper cover and the lower shell each having a cylindrical shape with an elliptical horizontal cross section, and being engageable with each other at the elliptical horizontal cross sections;

the elliptical horizontal cross sections of the upper cover and the lower shell each having a major axial centerline and a minor axial centerline, and the respective major axial centerlines and the respective minor axial centerlines being aligned to coincide with each other when the upper cover and the lower shell are engaged;

a cylinder block having a centerline being aligned to coincide with the major axial centerlines of the upper cover and the lower shell when viewed from above the upper cover; and a terminal pin located on the lower shell and symmetrically disposed with respect to a terminal pin bore centerline, first and second welding planes are positioned symmetrically relative to the major axial centerline, wherein a top surface of the upper cover is an asymmetric spherical contraction, a portion of the upper cover on a side of the terminal pin and a front side of the upper cover are higher than a rear side of the upper cover, wherein a bottom surface of the lower shell is a smooth ellipsoidal contraction, wherein the terminal pin bore centerline forms an angle with the major axial centerline, the angle is formed by a clockwise rotation of the terminal pin bore centerline from the elliptical major axial centerline forming an angle in a range of 10° to 45°, and wherein an internal side of a bottom portion of the lower shell is provided with four welding planes for internal support pins that support pump components inside the housing, wherein the first welding plane is among the four welding planes, the first and the second of the welding planes are symmetrically positioned on opposite sides of the elliptical major axial centerline, and the remaining two of the welding planes are spaced apart and positioned on the elliptical major axial centerline, and the four welding planes are positioned with an offset toward a rear portion of the compressor cylinder block.

2. The compressor housing according to claim 1, wherein:

welding surfaces are formed on the bottom surface of the lower shell, respectively on a side of the terminal pin and on an opposite side of the terminal pin, configured to weld compressor feet onto the lower shell, the welding surfaces each are curved and have a curvature consistent with that of the lower shell, the welding surfaces are distributed on opposite sides of the terminal pin bore centerline, the welding surfaces are distributed along a periphery of the bottom surface of the lower shell, and are configured to weld a welding end of the respective compressor feet, welding ends of the compressor feet each include a curved welding with two forked interconnections, the curved welding surfaces each upwardly arch and have a curvature consistent with that of the respective welding surfaces of the lower shell, supporting planes are provided at respective ends of the compressor feet opposite to the welding ends, the supporting planes are 3 to 8 mm away from a lowest point on the bottom surface of the lower shell, and a centerline connecting the supporting planes of the compressor feet on opposite sides is aligned to coincide with the terminal pin bore centerline.

3. The compressor housing according to claim 1, wherein at a location above the terminal pin bore, the upper cover and the lower shell are each provided with a positioning plane with an equal width, and the positioning planes make a smooth transition into the compressor housing.

4. The compressor housing according to claim 3, wherein the upper cover is provided with an enhancing groove at a location above the positioning planes, the enhancing groove is sunk below the outer surface of the upper cover into the inside of the upper cover and forms a smooth projection on the interior wall of the upper cover, and the enhancing groove includes a vertically straight strip.

5. The compressor housing according to claim 1, wherein the compressor housing is configured to use in a sealed refrigeration compressor.

6. A compressor housing, comprising:

an upper cover;

a lower shell;

the upper cover and the lower shell each having a cylindrical shape with an elliptical horizontal cross section, and being engageable with each other at the elliptical horizontal cross sections;

the elliptical horizontal cross sections of the upper cover and the lower shell each having a major axial centerline and a minor axial centerline, and the respective major axial centerlines and the respective minor axial centerlines being aligned to coincide with each other when the upper cover and the lower shell are engaged;

a cylinder block having a centerline being aligned to coincide with the major axial centerlines of the upper cover and the lower shell when viewed from above the upper cover; and a terminal pin located on the lower shell and symmetrically disposed with respect to a terminal pin bore centerline, first and second welding planes are positioned symmetrically relative to the major axial centerline, wherein a top surface of the upper cover is an asymmetric spherical contraction, a portion of the upper cover on a side of the terminal pin and a front side of the upper cover are higher than a rear side of the upper cover, wherein a bottom surface of the lower shell is a smooth ellipsoidal contraction, and wherein the terminal pin bore centerline forms an angle with the major axial centerline, the angle is formed by a clockwise rotation of the terminal pin bore centerline from the elliptical major axial centerline forming an angle in a range of 10° to 45°, and wherein:

the lower shell sidewall is provided with first and second lower shell retaining grooves that are symmetrically positioned with respect to the major axial centerlines, the upper cover is provided with a plurality of retaining grooves, wherein a first and a second retaining grooves of the plurality of retaining grooves are symmetrically positioned on opposite sides of the major axial centerlines, a third retaining groove of the plurality of retaining grooves is positioned on the major axial centerline and at a location above a rear portion of the compressor cylinder block, and the plurality of retaining grooves of the upper cover are sunk below an outer surface of the upper cover into an inside of the upper cover and form projections on an interior wall of the upper cover or the lower shell, and the first and second lower shell retaining grooves of the lower shell are sunk into an inside of the lower shell and form projections on an interior wall of the lower shell.

7. The compressor housing according to claim 6, wherein the shape of the retaining grooves is one of circular, oval, and smooth polygonal.

* * * * *